United States Patent [19]

Reybould

[11] Patent Number: 4,594,104

[45] Date of Patent: Jun. 10, 1986

[54] CONSOLIDATED ARTICLES PRODUCED FROM HEAT TREATED AMORPHOUS BULK PARTS

[75] Inventor: Derek Reybould, Denville, N.J.

[73] Assignee: Allied Corporation, Morris Township, Morris County, N.J.

[21] Appl. No.: 727,940

[22] Filed: Apr. 26, 1985

[51] Int. Cl.[4] ..... C22C 29/00

[52] U.S. Cl. ..... 75/243; 75/123 B; 75/123 R; 75/123 D; 75/123 L; 75/124; 75/123 M; 420/424; 420/425; 420/426; 420/427; 420/428; 420/429; 420/431; 420/435; 420/437; 420/439; 420/440; 420/441; 420/445; 420/446; 420/451; 419/39; 419/41; 419/48; 419/53

[58] Field of Search ..... 75/123 R, 124, 123 B, 75/123 D, 123 L, 123 M, 243; 419/38, 39, 23, 41, 48, 53; 420/424, 425, 426, 427, 428, 429, 431, 435, 437, 439, 440, 441, 445, 446, 451

[56] References Cited

U.S. PATENT DOCUMENTS

| | | | |
|---|---|---|---|
| 4,297,135 | 10/1981 | Giessen et al. | 75/246 X |
| 4,347,076 | 8/1982 | Ray et al. | 75/249 |
| 4,377,622 | 3/1983 | Liebermann | 428/605 |
| 4,381,197 | 4/1983 | Liebermann | 419/24 |
| 4,381,943 | 5/1983 | Dickson et al. | 75/2.51 |
| 4,439,236 | 3/1984 | Ray | 75/123 B |
| 4,503,085 | 3/1985 | Dickson et al. | 427/34 |

OTHER PUBLICATIONS

M. von Heimendal et al., "The Activation Energies of Crystallization in the Amorphous Alloy METGLAS 2826 A", *J. of Mat. Sci., 16, 1981, pp. 2405–2410.*

R. S. Tiwari et al., "The Effect of Tensile Stress on the Crystallization Kinetics of Metglas 2826 $Fe_{40}Ni_{40}P_{14}B_6$", Materials Science and Engineering, 55 (1982) pp. 1–7.

H. Liebermann, "Warm Consolidation and Cladding of Glassy Alloy Ribbons", *Mat. Sci. Eng.*, 46 (1980) pp. 241–248.

*Primary Examiner*—Stephen J. Lechert, Jr.

*Attorney, Agent, or Firm*—Paul Y. Yee; James Riesenfeld; Gerhard H. Fuchs

[57] ABSTRACT

The present invention provides a method for producing a consolidated article composed of a transition metal alloy. The method includes the step of selecting a rapidly solidified alloy which is at least about 50% glassy. The alloy is formed into a plurality of alloy bodies, and these alloy bodies are compacted at a pressing temperature of not more than about 0.6 Ts (solidus temperature in °C.) to consolidate and bond the alloy bodies together into a glassy metal compact having a density of at least about 90% T.D. (theoretical density). The compacted glassy alloy bodies are then heat treated at a temperature generally ranging from about 0.55–0.85 Ts, but, in any case, above the alloy crystallization temperature, for a time sufficient to produce a fine grain crystalline alloy structure in the compacted article.

26 Claims, 12 Drawing Figures

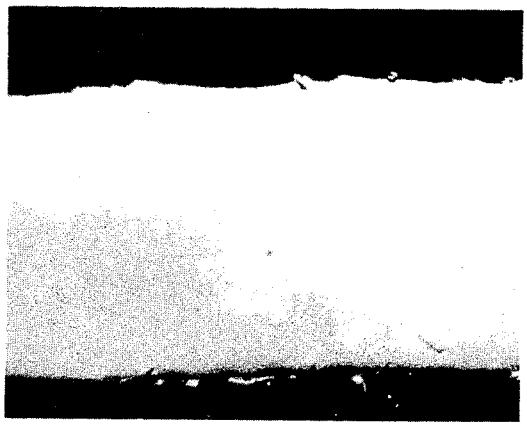
FIG. 3a
AS CAST
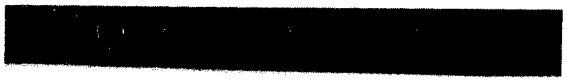
FIG. 3b
600°C
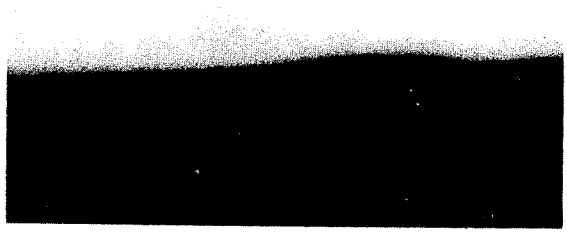
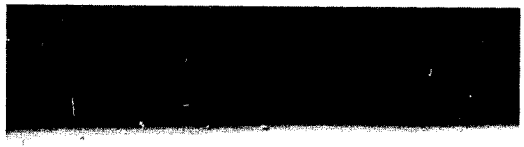
FIG. 3c
700°C
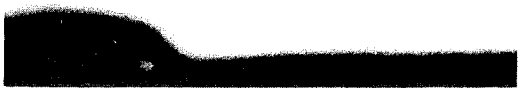

800°C

900°C

1100°C

CONSOLIDATED ARTICLES PRODUCED FROM HEAT TREATED AMORPHOUS BULK PARTS

FIELD OF THE INVENTION

The invention relates to three dimensional articles consolidated from alloys which have been rapidly solidified from the melt. In particular, the invention relates to articles which have been consolidated from rapidly solidified alloys and have increased strength, hardness and ductility.

BACKGROUND OF THE INVENTION

U.S. Pat. No. 4,297,135 to Giessen, et al. discloses alloys of iron, cobalt, nickel and chromium containing both metalloids and refractory metals. The alloys are rapidly solidified at cooling rates of $10^5$–$10^7$° C./sec. to produce an ultrafine grained metastable crystal structure having enhanced compositional homogeneity. Heat treatment converts the metastable, brittle alloys into ductile alloys with primary grains of ultrafine size which contain an ultrafine dispersion of boride as well as carbide and/or silicide particles. The powders or ribbons can be consolidated into bulk parts, and the heat treated alloys possess good mechanical properties, in particular high strength and hardness, as well as good corrosion resistance for selected compositions.

U.S. Pat. No. 4,381,943 to J. Dickson, et al. discloses a chemically homogeneous, microcrystalline powder for deposition onto a substrate. The powder is a boron containing alloy based in Fe, Ni, Co or a combination thereof.

M. Von Heimendal, et al.; in the article "The Activation Energies of Crystallization in the Amorphous Alloy METGLAS® 2826A", *Journal of Materials Science,* 16, (1981), pp. 2405–2410; discuss the nucleation and growth rates of the metastable phase crystals of the amorphous alloy $Fe_{32}Ni_{36}Cr_{14}P_{12}B_6$. R. S. Tiwari, et al.; in the article, "The Effect of Tensile Stress on the Crystallization Kinetics of Metglas® 2826 $Fe_{40}Ni_{40}P_{14}B_6$", *Materials Science and Engineering,* 55 (1982), pp. 1–7; discuss the influence of tensile stress on the crystallization kinetics of Metglas® 2826. The nucleation rate of the eutectic crystals was found to increase markedly with increasing stress, whereas no influence was detected on growth rate.

U.S. Pat. No. 4,439,236 to R. Ray discloses boron-containing transition metal alloys based on one or more of iron, cobalt and nickel. The alloys contain at least two metal components and are composed of ultra fine grains of a primary solid solution phase randomly interspersed with particles of complex borides. The complex borides are predominately located at the junctions of at least three grains of the primary solid-solution phase. The ultra fine grains of the primary solid solution phase can have an average diameter, measured in their longest dimension, of less than about 3 micrometers, and the complex boride particles can have an average particle size, measured in their largest dimension, of less than about 1 micrometer, as viewed on a microphotograph of an electron microscope. To make the alloys taught by Ray, a melt of the desired composition is rapidly solidified to produce ribbon, wire, filament, flake or powder having an amorphous structure. The amorphous alloy is then heated to a temperature ranging from about 0.6–0.95 of the solidus temperature (measured in °C.) and above the crystallization temperature to crystallize the alloy and produce the desired microstructure. The amorphous alloy ribbon, wire, filament, flake or powder taught by Ray is consolidated under simultaneous application of pressure and heat at temperatures ranging from about 0.6–0.95 of the solidus temperature.

The following documents disclose the consolidation of amorphous alloys at a pressing temperature below the alloy crystallization temperature to produce amorphous metal compacts (which are, however, brittle) and to produce claddings:

1. U.S. Pat. No. 4,381,197 to H. Liebermann;
2. U.S. Pat. No. 4,377,622 to H. Liebermann;
3. H. Liebermann, "Warm Consolidation and Cladding of Glassy Alloy Ribbons", *Mat. Sci. Eng.,* 46 (1980) pp. 241–248.

U.S. Pat. No. 4,503,085 to Dickson, et al. discloses amorphous alloy powders that are capable of being heated and deposited on a substrate to form a bonded, amorphous alloy layer.

Other boron-containing transition metal alloys have been conventionally cooled from the liquid to the solid crystalline state. Such alloys can form continuous networks of complex boride precipitates at the crystalline grain boundaries. These networks can decrease the strength and ductility of the alloy.

Powders of rapidly solidified, transition metal alloys have previously been processed by conventional powder metallurgy to produce compacted crystalline alloy articles. Indeed, the ability of the powders to be processed by such techniques has been one of the advantages cited for such alloys and powders. Conventional processing, however, limits the properties attainable with these alloys because it exposes the alloys to excessively high temperatures that can greatly diminish the advantages of the rapid solidification. If during conventional processing the alloy is not exposed to high temperatures, then incomplete interparticle bonding can occur, resulting in a material with low toughness and, in the extreme case, low strength. Conventional techniques have not been capable of producing the desired consolidation and bonding while retaining the fine microstructure afforded by rapid solidification. As a result, the consolidated articles do not have desired levels of hardness, strength, and toughness.

SUMMARY OF THE INVENTION

The present invention provides a method for consolidating rapidly solidified, transition metal alloys. The method includes the step of selecting a rapidly solidified alloy which is at least 50% glassy. The alloy is formed into a plurality of alloy bodies, and the alloy bodies are compacted at a pressing temperature of not more than about 0.6 Ts (solidus temperature measured in °C.) to consolidate and bond the alloy bodies together into a glassy metal compact having a density of at least about 90% T.D. The compacted glassy alloy bodies are heat treated at a heat treatment temperature ranging from about 0.55–0.85 Ts and above the alloy crystallization temperature (Tx) for a time sufficient to produce a fine grain crystalline alloy structure in the compacted article.

The invention further provides a consolidated article with increased strength and toughness. The article is composed of a crystalline, transition metal alloy consisting essentially of the formula $M_aT_bX_c$, wherein "M" is one or more elements selected from the group consisting of Fe, Co, Ni, W, Mo, Nb, V, Ta and Cr, "T" is one or more elements selected from the group consisting of Al and Ti, "X" is one or more elements selected from the group consisting of B, C, Si and P, "a" ranges from about 50–95 at. %, "b" ranges from about 0–40 at. %, "c" ranges from about 5–30 at. % and a+b+c=100. The consolidated alloy has a grain size not more than about 2 micrometers and may contain substantially spherical, separated precipitate particles which measure not more than 4 micrometers in average diameter. These precipitates are substantially uniformly dispersed throughout the alloy.

The improved method of the invention distinctively processes rapidly solidified glassy metal alloys to produce crystalline alloy articles having an advantageous combination of strength and toughness desired for various structural applications. The method distinctively consolidates and bonds the alloy particles together while they are in the amorphous state, and then heat treats the compacted glassy metal article to crystallize the alloy and form a very fine grained structure. As a result, there can be more flexibility during manufacturing and more precise control of the formation of precipitates within the consolidated article. Consolidated articles produced from the alloys are substantially free of continuous networks of precipitates and are well bonded. Such articles are particularly useful for dies, machine tooling, and the like.

BRIEF DESCRIPTION OF THE DRAWINGS

The invention will be more fully understood and further advantages will become apparent when reference is made to the following detailed description and accompanying drawings in which:

FIG. 3*a*–3*f* shows micrographs of metal alloy ribbon after heat treatment at various temperatures.

DETAILED DESCRIPTION OF THE INVENTION

Figure 1A:
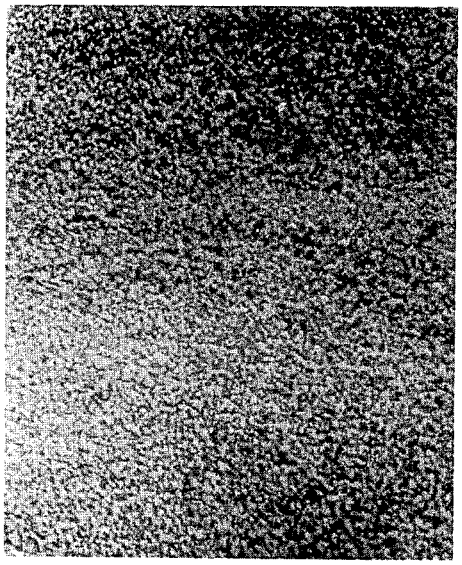
FIG. 1*a*–1*b* shows scanning electron micrographs of metalloid precipitates in an article of the present invention.

In accordance with the present invention, a rapidly solidified alloy, which is at least about 50% glassy, is formed into a plurality of alloy bodies. The alloy bodies are compacted together to form a glassy metal compact which has a density of at least about 90% T.D. (theoretical density). The compacted, glassy metal alloy is then heat treated at a temperature which ranges from about 0.55–0.85 Ts (solidus temperature in °C.) and which is above the alloy crystallization temperature (Tx). This heat treatment continues for a time sufficient to produce a desired fine-grain crystalline alloy structure within the consolidated article.

Alloys that can be employed in the practice of the present invention consist essentially of the formula $M_aT_bX_c$, wherein "M" is one or more elements selected from the group consisting of Fe, Co, Ni, W, Mo, Nb, V, Ta and Cr, "T" is one or more elements selected from the group consisting of Al and Ti, "X" is one or more elements selected from the group consisting of B, C, Si and P, "a" ranges from about 50–95 at. %, "b" ranges from about 0–40 at. %, "c" ranges from about 5–30 at. % and a+b+c=100. In a preferred alloy, "M" is one or more elements selected from the group consisting of Fe, Co, Ni, W, Mo, V, and Cr; "X" is one or more elements selected from the group consisting of B, C, and Si; "a" ranges from about 70–95 at. %; "b" is 0; and "c" ranges from about 5–30 at. %. In a further aspect of the invention, the alloys employed consist essentially of the formula $M'_{bal}B_fX'_g$, wherein M' is one or more elements selected from the group consisting of Fe, Ni, Mo and W, B is boron, X' is one or more elements selected from the group consisting of C and Si, "f" ranges from about 5–25 at. %, "g" ranges from about 0–20 at. %, and "bal" indicates the balance.

Tungsten, molybdenum, niobium, and tantalum increase physical properties such as strength and hardness, and improve thermal stability, oxidation resistance and corrosion resistance in the consolidated product. The amount of these elements should be limited to less than about 40 at. % because it is difficult to fully melt alloys with compositions greater than the stated amounts and still maintain the homogeneous nature of the alloy.

The elements aluminum and titanium promote a precipitation hardening phase. The volume fraction of the hardening precipitates, however, should be limited to avoid the formation of networks.

Chromium provides strength and corrosion resistance, and the amount of the chromium is limited to control the melting temperature of the alloys.

Boron and carbon provide the borides and carbides that promote hardening in the consolidated alloy. The lower limit for "d" assures sufficient boron and carbon to produce the required borides and carbides. The upper limit assures that continuous networks of the borides and carbides will not form.

Phosphorus and silicon help promote the formation of a glassy (amorphous) structure in the alloy, and aid in assuring a homogeneous alloy after casting. Silicon is further preferred because it helps provide corrosion resistance in the alloy and forms silicide precipitates.

Alloys are prepared by rapidly solidifying a melt of the desired composition at a quench rate of at least about $10^{5°}$ C. per second, employing metal alloy quenching techniques well known to the rapid solidification art; see for example, U.S. Pat. No. 4,142,571 to Narasimhan, which is hereby incorporated by reference thereto.

Sufficiently rapid quenching conditions produce a homogeneous, glassy material. In the glassy material, there is no long range order. X-ray diffraction patterns of glassy metal alloys show only a diffuse halo, similar to that observed for inorganic oxide glasses. Such glassy alloys must be at least 50% glassy, preferably are at least 80% glassy and more preferably are substantially 100% glassy, as determined by X-ray diffraction analysis, to attain desired physical properties. Glassy alloy bodies, such as filament, strip, flake or powder consisting essentially of the alloy compositions described above, can be consolidated into amorphous three-dimensional consolidated articles.

In a particular aspect of the invention, however, the alloy bodies are consolidated by dynamic compaction, such as by a high speed punch. The dynamic compaction with the high speed punch should include a compaction velocity ranging from about 100–2000 m/s and preferably includes a compaction velocity ranging from about 600–2000 m/s.

The dynamic compaction technique provides compaction with a shock wave that operates primarily on the surfaces of the alloy bodies (e.g. powder particles). This raises the temperature of the surfaces enough to produce strong interparticle welding. However, since the duration of the temperature rise is very short, there is no significant crystallization of the alloy. The compacted glassy metal article has a density of at least about 90% T.D. (theoretical density), preferably has a density of at least about 95% T.D. and more preferably has a density of about 100% T.D.

In another aspect of the invention, the alloy bodies are warm consolidated at a pressing temperature, which is not more than about 0.6 Ts (solidus temperature measured in °C.). In further aspects of the invention, the pressing temperature ranges from about 0.6–1.1 $T_x$ (crystallization temperature measured in °C.), and preferably ranges from about 0.8 to 0.95 $T_x$. The compaction at these relatively low pressing temperatures advantageously allows substantially full densification of the alloy bodies into a glassy metal compacted article without producing undesired precipitates. The compacted alloy article has a density of at least about 90% T.D., preferably has a density of at least about 95% T.D., and more preferably has approximately the theoretical maximum density (100% T.D.). In addition the compacted alloy is preferably not more than 15% crystalline.

The warm consolidation takes advantage of the softening and decrease in the resistance to flow which occurs in glassy metal alloys at elevated temperatures that are below the alloy crystallization temperature. In particular amorphous alloys, this softening is evidenced by a distinct glass transition temperature Tg; in other alloys this Tg is not a well defined temperature. In either case, the relative softening of the glassy alloy allows a more effective compaction and bonding between the alloy bodies. The ease and degree of the interparticle bonding is significantly greater than that afforded when the alloy is crystallized prior to or during the consolidation/-bonding process.

The compacted alloy bodies are heat treated at a heat treatment temperature ranging from about 0.55–0.85 Ts for a time period sufficient to produce a crystalline alloy having increased hardness and toughness.

Where the glassy alloy has been warm consolidated, the glassy metal compact may be hot formed during the heat treatment process to increase the interparticle bonding and/or increase the densification of the final crystalline alloy article. This hot forming may, for example, be provided by extrusion, forging or the like.

The heat treated consolidated articles of the invention have a distinctive microstructure composed of very fine grains of a crystalline matrix having an average grain diameter of less than about 2 micrometers.

The heat treated crystalline alloy may be substantially free of metalloid (e.g. B, C, Si, P) precipitates. In such case, the constituent amounts of boron, carbon, silicon and/or phosphorous are held unprecipitated in a solid solution phase. The heat treated crystalline alloy may also contain precipitates composed of one or more metalloid compounds selected from the group consisting of borides, carbides, silicides and phosphides. When such precipitates are present, they form a substantially uniform dispersion of very fine, separated particles that have a maximum particle size of not more than 4 micrometers. Preferably, the maximum size of the particles is less than about 2 micrometers, more preferably is less than about 1 micrometer, and most preferably is less than about 0.5 micrometer. The grain sizes and precipitate particle sizes can be measured by viewing a microphotograph.

Whether or not a consolidated article contains metalloid precipitates, a preferred embodiment of the article includes, admixed and consolidated in the article, at least one additional crystalline alloy selected from the same formula ($M_aT_bX_c$) but having a different composition, i.e., at least one of the parameters in the additional alloy is different.

Figure 1B:
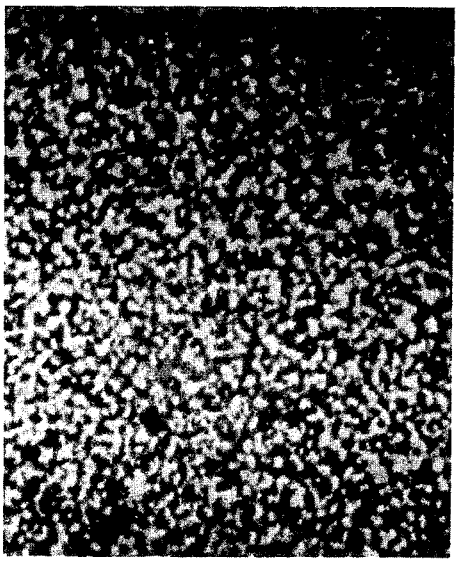

FIG. 1 shows a scanning electron micrograph of an article of the present invention having the composition $Ni_{56.5}Mo_{23.5}Fe_{10}B_{10}$. The metalloid precipitates (seen as the lighter colored regions) have distinctive, rounded outlines, which are approximately spheroidal or oblatespheroidal in shape. In contrast, the same alloy compacted into a consolidated article by a conventional one-step hot consolidation process, has rectangular or polygonal precipitates (e.g. borides) with sharp angled outlines, as representatively shown in FIG. 2. The rounded outlines and the small sizes of the metalloid precipitates can advantageously increase the ductility and toughness of the consolidated article, of the present invention.

The following Examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

A $Ni_{56.5}Mo_{23.5}Fe_{10}B_{10}$ alloy was jet cast by directing a stream of liquid metal onto an outer peripheral rim surface of a cooled wheel rotating to provide a quench surface speed of around 60 mph. This produced a ribbon or filament with an amorphous structure, as confirmed by X-ray analysis. For this alloy, Ts is about 1270° C. and Tx is about 540° C. The filament was comminuted into powder having a particle size of less than 35 mesh (500 micrometers). The powder was compacted to a 99% T.D. dense solid by dynamic compaction in which a gas driven gun was employed to impact a punch traveling at about 1000 to 1200 m/s. against powder located in a standard compaction chamber. Alternatively, explosive compaction could be used; this would involve placing the powder into a can around which explosives would be detonated. Both techniques involve the cold compaction of powder by the passage of a shock wave which deposits the work of compaction on the surface of the particles and raises the surface temperature sufficently to produce interparticle welding. The duration of this rise in temperature is, however, too short to cause significant crystallization. The result is a strong bulk solid which retains the amorphous structure of the powder. Several compacts of $Ni_{56.5}Mo_{23.5}Fe_{10}B_{10}$ were produced using the gas gun and an impact velocity of 1100 m/s.

Samples were heat treated by placing them in a vacuum furnace for ½ hour at several temperatures. It was surprisingly found that their hardness, HRC (Rockwell C hardness), could be increased above that of the as-compacted amorphous solid.

TABLE 1

| | HRC |
|---|---|
| As-Compacted | 50 |

TABLE 1-continued

| | HRC |
|---|---|
| Heat Treated 800° C. (0.63 Ts) | 55 |
| Heat Treated 900° C. (0.709 Ts) | 47.5 |
| Heat Treated 1000° C. (0.787 Ts) | 45 |

These data were confirmed in further tests. In addition it was found that time at temperature was important, as shown in Table II

TABLE II

| | HRC | |
|---|---|---|
| | ½ hr | 4 hr |
| Heat Treated 800° C. | 55 | 58 |

These specimens had 0.5 to 1% residual porosity; consolidation at higher impact velocities to produce full densification would be expected to produce still higher hardness values. Even so, the hardness values obtained are significantly above those obtained by conventional processing of this alloy. Conventional consolidation has involved HIPing at 1100° C. for 4 hours and has given a hardness of 46 to 48 HRC which can be raised to around 49 HRC by "aging" at 800° C.

The advantages of the low temperature heat treatment of dynamic compacts were confirmed by subjecting specimens previously heat treated at several different temperatures to an aging treatment, Table III.

TABLE III

| Heat Treated for 1 hr. at temperature (°C.) | As Heat Treated (HRC) | Heat Treated and Aged at 800° C. for 4 hrs. (HRC) |
|---|---|---|
| 800 | 58.5 ± 4 | 58 ± 1.5 |
| 900 | 52.5 ± 2 | 54 ± 1.0 |
| 1000 | 46.0 ± 2.5 | 45 ± 1.5 |
| Conventional Material | 48 ± 1.5 | 49 ± 1.0 |

The structure of the dynamically compacted and heat treated specimens was not resolvable by optical microscopy. Scanning electron microscopy showed that a specimen heat treated at 950° C. for 1 hour contained very fine borides (see FIG. 1). These borides were less than 1 micrometer in size and were significantly finer than borides found in standard/conventional material. Surprisingly, these fine borides were very uniformly dispersed and had a substantially spherical shape rather than the angular polygonal or rectangular shapes of the borides in the conventional material. Thus, when borides are precipitated by the heat treatment of the present invention, they are significantly different than previously reported borides. However, the physical metallurgy of this alloy indicates that while crystallization occurs for this alloy around 540° C., it is not until around 750° C. (0.59 Ts) that precipitation of the borides occurs. Therefore, specimens heat treated below 750° C. would remain single phase with no borides present.

Thus, amorphous alloys may be advantageously consolidated in the amorphous state and then heat treated to give a desired microstructure.

EXAMPLE 2

A 12.7 mm wide ribbon of alloy $Ni_{60}Mo_{30}B_{10}$ was cast by planar flow casting on to a rotating wheel to produce an amorphous ribbon. For this alloy Ts is about 1260° C., and Tx is about 550° C. The ribbon was cut into short samples which were heat treated for a period of 1 hour in a standard furnace under argon. The resultant Vickers microhardness (Hv) values of the heat treated specimens were measured, and are set forth in Table IV.

TABLE IV

| Temperature of Heat Treatment (°C.) | Microhardness Hv (0.1)* |
|---|---|
| As-Cast | 1100 ± 80 |
| 550 (0.436 Ts) | 1220 ± 70 |
| 600 (0.476 Ts) | 1370 ± 140 |
| 700 (0.555 Ts) | 1370 ± 80 |
| 800 (0.635 Ts) | 1375 ± 70 |
| 900 (0.714 Ts) | 1000 ± 40 |
| 1000 (0.794 Ts) | 860 ± 70 |
| 1100 (0.873 Ts) | 630 ± 100 |

*0.1 kg load

The heat treated alloy increased in hardness compared to the as-cast amorphous alloy, and there was approximately a doubling of the hardness compared to crystalline alloys produced at a conventional processing temperature of 1100° C.

Figure 2A:
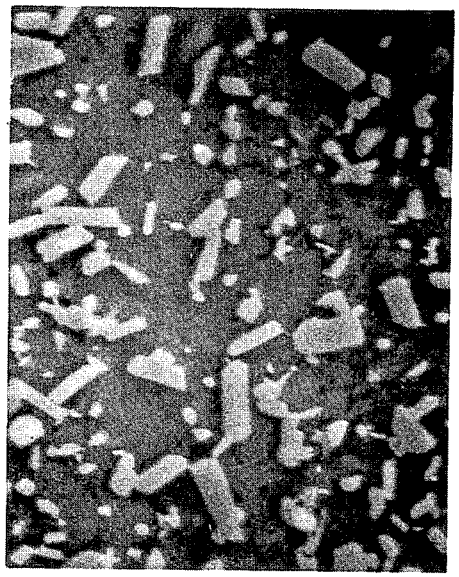
FIG. 2*a*–2*b* shows scanning electron micrographs of precipitates in an article of the composition of FIG. 1, but prepared by a prior art method.
Figure 2B:
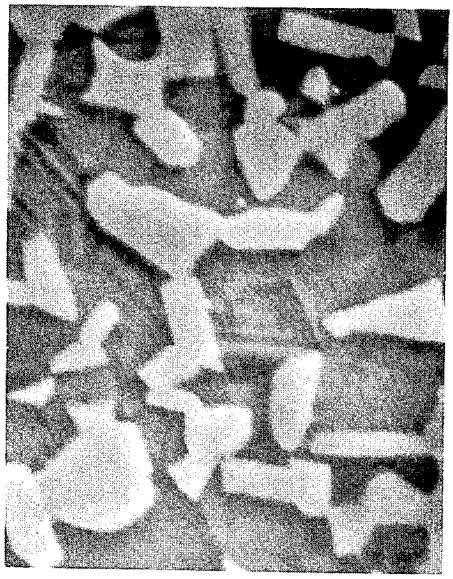
Figure 3D:
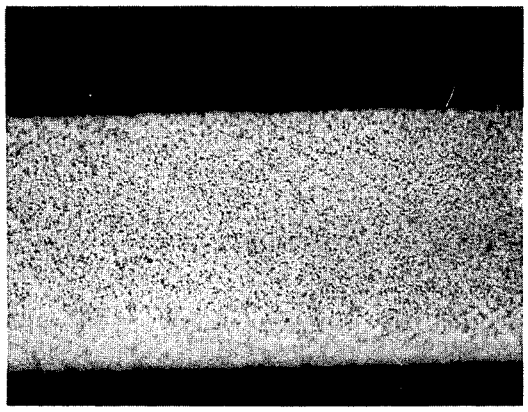
Figure 3E:
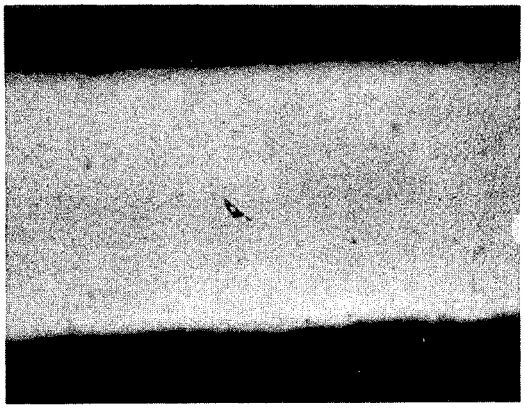
Figure 3F:
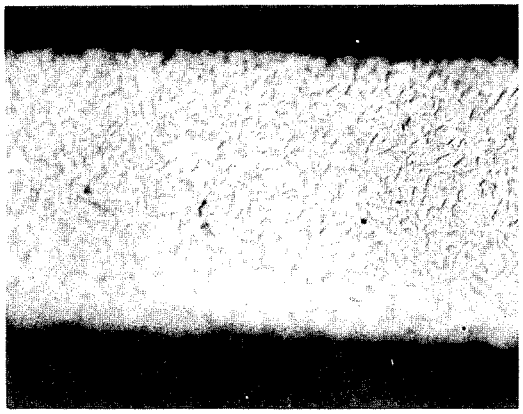

These observations can be correlated with our understanding of the physical metallurgy of this alloy, which is very similar to that of the $Ni_{56.5}Mo_{23.5}Fe_{10}B_{10}$ alloy in Example 1. Differential scanning calorimetry, DSC, shows that crystallization occurs at around 550° C. and that precipitation of the borides requires a temperature of 750° C. (0.595 Ts). This is confirmed in the micrographs of the heat treated ribbon, FIG. 3. Maximum hardness was obtained both prior to and immediately after boride precipitation. Note that heat treatment at 1100° C. yields a structure similar to that of prior art HIPed material (FIG. 2).

EXAMPLE 3

Figure 4:
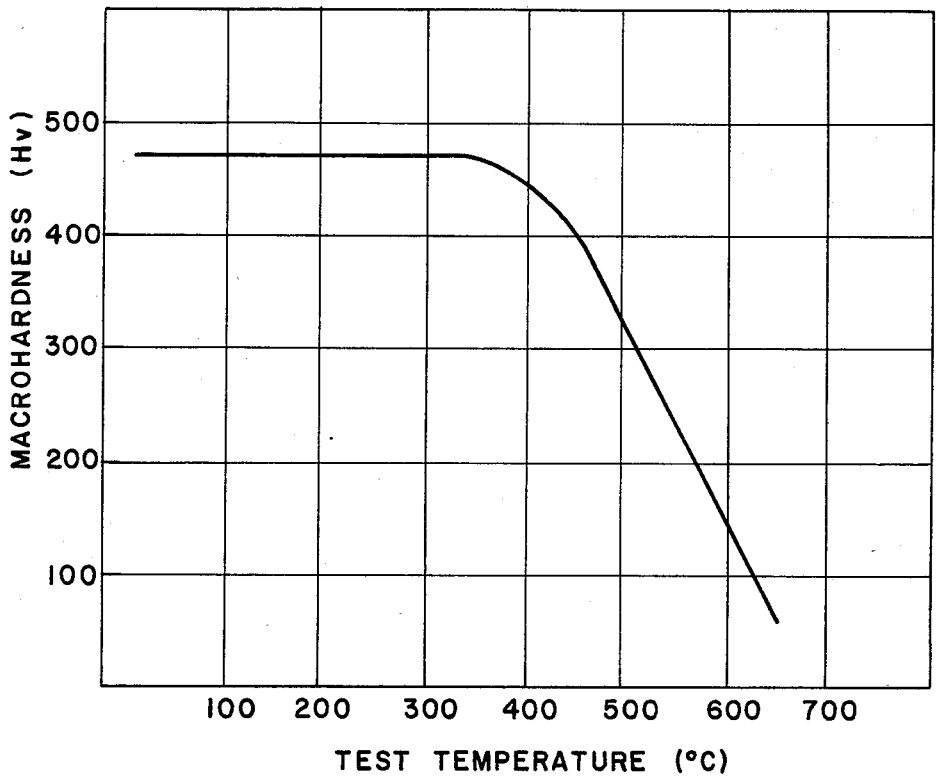
FIG. 4 is a graph of hot hardness vs. test temperature for a dynamically compacted alloy billet.

Dynamic compaction produces a high density amorphous compact which has a high as-compacted strength. It requires however special equipment. Other alternative ways of consolidating the amorphous powders were therefore investigated. One possibility was found to be warm pressing the powder at a temperature below the crystallization temperature of the alloy. This capitalizes on the significant softening of the amorphous alloy that occurs as the crystallization temperature is approached and is illustrated in FIG. 4, which shows hot hardness data for a dynamically compacted billet of alloy $Fe_{78}Si_{13}B_9$. Warm pressing requires the use of high pressures and may not produce as strong or as well bonded a compact as is produced by dynamic compaction. As a result, the heat treatment stage may by required to increase the interparticle bonding. This may necessitate the use of a higher heat treatment temperature, or the use of a hot pressing or forging operation to increase the interparticle bonding and perform the heat treatment.

To explore this technique, glassy compacts were made of the alloy $Fe_{78}B_{13}Si_9$, which has a Ts of about 1110° C. and a Tx of about 550° C. A range of pressing pressures, temperatures and times at pressure was employed. Using a pressure of 1035 MPa and a duration of 15 min. at 400° C., a 96% T.D. compact was produced; pressing at 460° to 470° C. (0.85–0.87 Tx) produced a 99% T.D. compact, while pressing at 500° C. (0.93 Tx) produced a 99% T.D. density compact in which some of the alloy had crystallized. In general, increasing one variable allowed the other two to be decreased; pressures above 1035 MPa and temperatures between 460° C. and 500° C. would allow a decrease in the compacting time. Times of 2–5 min. readily allowed compaction to over 98% T.D., and it was found that 10% or less crystallization of the compact was not detrimental.

Amorphous compacts produced by this technique were investigated by a variety of tests. Samples were, for instance, heat treated at several temperatures and their microhardness and microstructure determined. A small increase in hardness was observed, as shown in Table V, especially around the crystallization temperature of this alloy (about 540° C.). Boride precipitation followed crystallization with this alloy.

TABLE V

| Heat Treatment Temperature, 1 hr (°C.) | Microhardness Hv (0.1) | Boride Size (Micrometers) |
|---|---|---|
| As Compacted | 1050 ± 50 | Amorphous |
| 545 | 1190 ± 90 | not visible optically |
| 575 | 1100 ± 70 | not visible optically |
| 580 | 1025 ± 80 | not visible optically |
| 600 | 950 ± 100 | not visible optically |
| 700 | 900 ± 40 | less than 0.75 |
| 800 for 2 hrs. | 900 ± 40 | 0.25 to 2 |
| 900 | 750 ± 40 | 1 to 4 |

It will be apparent to one skilled in the art that not only are these very high hardness values for such a simple iron based alloy, but also the microstructures are extremely fine for an alloy which contains no refractory alloy additions, such as W, Mo, Co, etc. Exposure of an iron based alloy without these refractory alloy additions to even a moderately high temperature is known to result in rapid deterioration. Even hot working tool steels, which are highly alloyed with such alloy additions cannot ordinarily be exposed to temperatures over 600° C. without incurring significant, permanent softening, which would render the material unusable.

Figure 5:
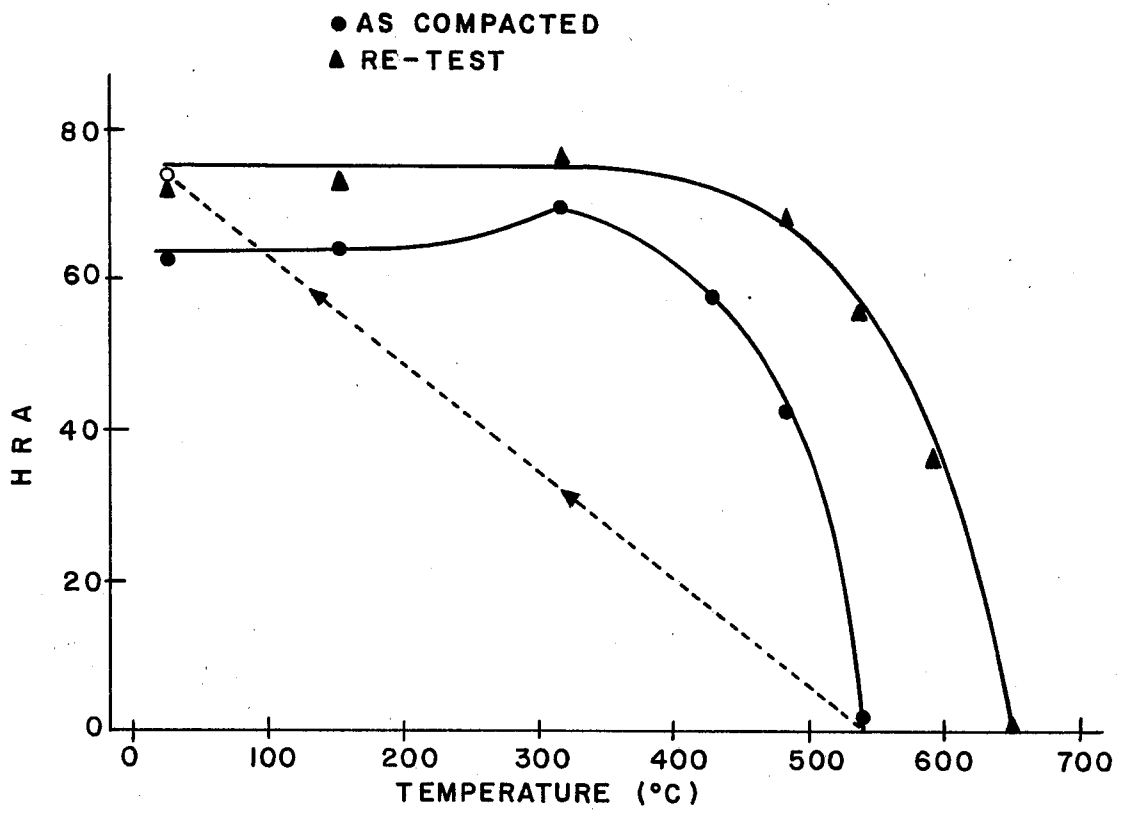
FIG. 5 is a graph of hot hardness vs. temperature of a warm pressed alloy billet.

The change in microstructure that occurs on heat treating the amorphous compacts and the advantages this can produce in mechanical properties are further illustrated by the hot hardness data for a fully dense amorphous compact of the alloy $Fe_{79}B_{16}Si_5$, FIG. 5. For this alloy, Ts is about 1150° C. and Tx is about 515° C. It can be seen that an increase in hardness occurs at around the crystallization temperature. Due to the long exposure times, crystallization can occur at a lower temperature than that indicated by DSC. It should be observed in FIG. 5 that this increase in hardness is retained on returning to room temperature, even after a second exposure to the hot hardness test. Conventional tool steels exposed to the hot hardness test temperatures would ordinarily exhibit a consistant decrease in room temperature hardness after each retest.

Further work on $Fe_{78}Si_{13}B_9$ investigated the transverse, 3-point bend strength as a function of the heat treatment temperature, Table VI. The increase in the transverse rupture strength (T.R.S.) indicates an increase in the ductility/toughness of the material. The hardness is related to the tensile yield strength, while the rupture (or bend) strength is related to the tensile strength and ductility.

TABLE VI

| Temperature of Heat Treatment (°C.) | Time of Heat Treatment under argon (hr.) | Transverse Rupture Strength (MPa) | HRC |
|---|---|---|---|
| As pressed | / | 179 | 38.5 ± 1.5 |
| 550 (0.495 Ts) | 1 | / | 42.0 ± 1.0 |

TABLE VI-continued

| Temperature of Heat Treatment (°C.) | Time of Heat Treatment under argon (hr.) | Transverse Rupture Strength (MPa) | HRC |
|---|---|---|---|
| 585 (0.527 Ts) | 1 | / | 42.0 ± 1.0 |
| 600 (0.54 Ts) | 1 | / | 42.0 ± 1.0 |
| 700 (0.63 Ts) | 1 | / | 42.0 ± 1.0 |
| 800 (0.72 Ts) | 1 | 266 | 45.0 ± 2.0 |
| 800 (0.72 Ts) | 4 | 800 | 46.0 ± 1.0 |
| 900 (0.81 Ts) | 1 | 1070 | 51.0 ± 1.0 |

It is important to emphasize that the excellent properties shown in Table VI are a result of first pressing amorphous iron powder at a temperature of 450° C., and then heat treating to form the amorphous compact at a temperature significantly below that conventionally employed for sintering iron powder. This technique attains a high density compact by taking advantage of the softening of the amorphous compact which occurs at temperatures approaching Tx. In addition, the surface activity of the amorphous material at such temperatures is believed to be high. These factors, together with the crystallization of the alloy, promote good interparticle bonding. This is further illustrated in Table VII, which shows in more detail the effect of heat treatment temperature and time on the mechanical properties. Argon was used as the protective gas for the heat treatment.

TABLE VII

| Temperature (°C.) | ½ hr. at temperature HRC | ½ hr. at temperature T.R.S. (MPa) | 1 hr. at temperature HRC | 1 hr. at temperature T.R.S. (MPa) |
|---|---|---|---|---|
| 800 | 43 ± 2 | 290 | 50 ± 0.5 | 490 |
| 900 | 52 ± 2 | 1000 | 58 ± 2 | 1070 |
| 1000 | 52 ± 2 | 1350 | 49 ± 2 | 155 |

This confirms the previous work and demonstrates that the optimum parameters have not been determined. To optimize the heat treatment, various combinations of air and oil quenching from 800° C. and 900° C. were carried out with subsequent aging operations at 500° C., 550° C., 580° C., and 600° C. All gave good properties with no significant difference in final properties.

EXAMPLE 4

A group of different alloys was planar flow cast to produce a 2" or 4" wide amorphous ribbons. These ribbons were then comminuted into −35 mesh (500 micrometers) powder. However, one alloy $Co_{65.5}Fe_{4.5}Ni_3Mo_3B_{12.5}C_{12.5}$, was only available in a coarse flake of −2 mm size. Consolidation was carried out as described in Example 3, and the temperature during compaction was maintained below the crystallization temperatures of the alloys. The compacts produced were amorphous and were over 99% T.D., except for the $Co_{65.5}Fe_{4.5}Ni_3Mo_3B_{12.5}C_{12.5}$, which because of the larger particle size, had 95% T.D.

The macrohardnesses of the resultant compacts are given in Table VIII. A somewhat higher value would have been obtained for the cobalt based alloy if greater densification had occurred.

TABLE VIII

| Alloy | Hardness Vickers, Hv | Tx (°C.) | Ts (°C.) |
|---|---|---|---|
| $Fe_{78}B_{13}Si_9$ | 1100 ± 100 | 540 | 1110 |
| $Fe_{40}Ni_{40}Mo_4B_{18}$ | 1300 ± 150 | 410 | 1050 |
| $Fe_{81}B_{13.5}Si_{13.5}C_2$ | 1050 ± 50 | 480 | 1120 |

TABLE VIII-continued

| Alloy | Hardness Vickers, Hv | Tx (°C.) | Ts (°C.) |
|---|---|---|---|
| $Fe_{79}B_{16}Si_5$ | 950 ± 100 | 515 | 1150 |
| $Co_{65.5}Fe_{4.5}Ni_3Mo_3B_{12.5}C_{12.5}$ | 900 + 150 | 400 | 1000 |

The hardnesses of the different alloys are relatively similar. Although the $Fe_{40}Ni_{40}Mo_4B_{18}$ gave the highest overall hardness, the benefit of this alloy over the much less expensive iron base alloys is small.

The most readily available iron base alloys were compared to the cobalt base alloy by hot Rockwell A (HRA) hardness testing after the alloys had been heat treated at 800° C. for 1 hr. The low density of the cobalt base alloy was expected to give it a low room temperature hardness, but it was believed that this compact would still exhibit superior hot hardness because of its cobalt base and the complex nature of its other additions. This was found not to be the case, Table IX. Therefore, for many applications the iron base alloys, particularly those with high boron contents, may be preferred because of their lower cost.

TABLE IX

| Temperature (°C). | Hardness (HRA) $Fe_{78}B_{13}Si_9$ | $Fe_{79}B_{16}Si_5$ | $Co_{65.5}Fe_{4.5}Ni_3Mo_3B_{12.5}C_{12}$ |
|---|---|---|---|
| Room Temp | 72 | 74 | 55 |
| 150 | 72 | 73 | 58 |
| 315 | 72 | 75 | 59 |
| 482 | 65 | 74 | 57 |
| 538 | 50 | 76 | 56 |
| 593 | 47 | 75 | 48 |
| 650 | 19 | 68 | 35 |
| 700 | 0 | 56 | 0 |
| 760 | 0 | 35 | 0 |

EXAMPLE 5

The alloy $Ni_{56.5}Mo_{23.5}Fe_{10}B_{10}$ was jet cast to form amorphous filment 2 mm wide. This was comminuted into a powder with a particle size of −35 mesh, (500 micrometers). The powder was consolidated by the warm pressing method described in Example 3. This alloy was more difficult to consolidate than previous alloys; a pressure of 966 MPa for a duration of 15 min and at a temperature of 470° C. produced a density of 95% T.D. Surprisingly, it was found that crystallization of 10% or more, as determined by X-ray analysis, produced a significant decrease in density. For example, pressing at 480° C. under the same conditions as used for 470° C. resulted in only a 88% T.D. compact. This decrease in density caused by the small amount of crystallization was not observed with the other alloys reported in Examples 3 and 4.

Higher densities were obtained with $Ni_{56.5}Mo_{23.5}Fe_{10}B_{10}$ by using higher pressures, shorter times, but slightly higher temperatures.

Heat treating these compacts at 800° C. for 2 hours crystallized the alloy and produced fine borides which were less than 0.5 microns in size and approximately spherical in shape. Heat treatment at lower temperature did not produce borides, as expected from the physical metallurgy of this alloy.

Full densification may be achieved by an isothermal forging of the glassy metal compacts at 700° to 900° C. As forging times can be short (1 to 15 min), extremely fine microstructures can be produced. It was even possible to increase the density by 3% (93 to 96% T.D.) by forging at about the pressing temperature of 470° C.

EXAMPLE 6

This approach of low temperature consolidation plus heat treatment also allows the production of compacts made from reactive mixtures, which would degrade if exposed to a high temperature. For instance, 20% by volume of fine diamonds were mixed with amorphous $Ni_{56.5}Mo_{23.5}Fe_{10}B_{10}$ powder and then warm pressed to form a consolidated billet with a 95% T.D. This was heat treated at 950° C. Higher temperatures would have graphitized the diamond. The $Ni_{56.5}Mo_{23.5}Fe_{10}B_{10}$ matrix of this compact had a hardness of 48 HRC. However, the diamonds gave the compact an exceptional wear resistance. Such compacts proved impossible to grind to size as they rapidly wore down the grinding wheel.

Other mixtures have also been made. For example the $Fe_{78}B_{13}Si_9$ glassy alloy has been mixed with the $Ni_{56.5}Mo_{23.5}Fe_{10}B_{10}$ glassy alloy. Small additions of the iron base alloy to the nickel based tool material allow easier consolidation of the latter to 99% T.D. Small additions of the nickel based tool alloy to the iron alloy increase the wear resistance of the latter.

A 30% by volume addition of the nickel based alloy to the iron based alloy was consolidated into a substantially full density glassy compact, and then heat treated at 800° C. for 1 hour. Diffusion between the two different alloys did not occur. The material had a bend strength of 828 MPa and a hardness of 48 HRC. The main advantage of this type of alloy is the improved wear resistance, which can be obtained with as little as 5% by volume addition of the hard Ni alloy phase.

EXAMPLE 7

Another way of producing an amorphous "bulk" material is plasma spraying an amorphous powder to form a thin coating on a selected substrate. A suitable plasma spraying technique is described by Dickson et. al., U.S. Pat. No. 4,381,943.

As indicated in the previous example, increased hardness and toughness can be obtained in these coatings if the amorphous alloys are crystallized by a heat treatment in which borides are not precipitated out or are precipitated out as fine, uniformly distributed spheres.

It is, therefore, apparent that the properties of amorphous coatings, expecially of alloys similar to the NiMoB type, could be improved if they were heat treated in the range 550°–900° C. This would also stress relieve the coating and could significantly improve its bond strength to the base metal. Since heat treatment can improve interparticle bonding, as indicated in Example 3, penetration of the coating by reactive liquids and subsequent corrosion of the base metal could be reduced.

The microhardness values of a plasma sprayed coating of $Ni_{56.5}Mo_{23.5}Fe_{10}B_{10}$ alloy after various low temperature heat treatments are shown in Table X. The maximum hardness values were produced by heat treatment at temperatures ranging from about 600°–800° C. (0.47–0.63 Ts). At 600° C., the hardness of the coating was increased by a factor of approximately 1.5 as compared to the as-sprayed condition. The lower hardness values obtained with the 0.1 kg load, Hv (0.1), compared to the 0.05 kg load, Hv (0.05), are due to some penetration of the coating by the hardness indentor.

The steel substrate below the coating had a hardness of only about 300 Hv.

TABLE X

| Heat Treatment Temperature (°C.) | Vickers Hardness Hv (0.05) | Hv (0.1) |
|---|---|---|
| As-sprayed | 650 ± 100 | 690 ± 100 |
| 600 (0.472 Ts) for 1 hr | 990 ± 100 | 935 ± 100 |
| 700 (0.551 Ts) for 1 hr | 1300 ± 175 | 860 ± 75 |
| 800 (0.63 Ts) for 1 hr | 990 ± 250 | 850 ± 60 |
| 800 (0.63 Ts) for 4 hr | 1020 ± 250 | 850 ± 160 |
| 900 (0.709 Ts) for 1 hr | 825 ± 20 | 800 ± 120 |

Having thus described the invention in rather full detail, it will be understood that such details need not be strictly adhered to but that various changes and modification may suggest themselves to one skilled in the art, all falling within the scope of the invention as defined by the subjoined claims.

I claim:

1. A method for producing a consolidated metal article, comprising the steps of:
   (a) selecting a rapidly solidified alloy, which is at least 50% glassy;
   (b) forming said alloy into a plurality of alloy bodies;
   (c) compacting said alloy bodies at a pressing temperature of not more than about 0.6 Ts (solidus temperature measured in °C.) and at a pressure sufficient to bond said alloy bodies together into a glassy metal compact having at least about 90% T.D.; and
   (d) heat treating said compacted alloy bodies at a heat treatment temperature ranging from about 0.55–0.85 Ts for a time period sufficient to provide a crystalline alloy consolidated article.

2. The method of claim 1, wherein said rapidly solidified alloy has a structure that is at least about 80% glassy.

3. The method of claim 1, wherein said rapidly solidified alloy is substantially 100% glassy.

4. The method of claim 1, wherein said glassy alloy consists essentially of the formula $M_aT_bX_c$, wherein "M" is one or more elements selected from the group consisting of Fe, Co, Ni, W, Mo, Nb, V, Ta and Cr, "T" is one or more elements selected from the group consisting of Al and Ti, "X" is one or elements selected from the group consisting of B, C, Si and P, "a" ranges from about 50–95 at. %, "b" ranges from about 0–40 at. %, "c" ranges from about 5–30 at. % and $a+b+c=100$.

5. The method of claim 1, wherein said selected, rapidly solidified alloy consists essentially of the formula $M'_{bal}B_fX'_g$, wherein M' is one or more elements selected from the group consisting of Fe, Ni, Mo and W, B is boron, X' is one or more elements selected from the group consisting of C and Si, "f" ranges from about 5–25 at. % and "g" ranges from about 0–20 at. %.

6. The method of claim 1, wherein said compacting step includes a dynamic compaction.

7. The method of claim 6, wherein said dynamic compaction is provided by a high speed punch moving at a speed ranging from about 100–2000 m/sec.

8. The method of claim 7, wherein said dynamic compaction is performed at a speed ranging from about 600–2000 m/sec.

9. The method of claim 1, further comprising the step of hot forming said compacted alloy during said heat treating step (d).

10. The method of claim 9, wherein said hot forming is provided by extrusion.

11. The method of claim 9, wherein said hot forming is provided by forging.

12. The method of claim 1 wherein the consolidation temperature, measured in °C., is between 0.6 and 1.1 Tx.

13. The method of claim 12 wherein the consolidation temperature is between 0.6 and 0.95 Tx.

14. The method of claim 12 wherein the consolidation temperature is between 0.8 and 0.95 Tx.

15. A consolidated article comprising a crystalline alloy consisting essentially of the formula $M_aT_bX_c$, wherein "M" is one or more elements selected from the group consisting of Fe, Co, Ni, W, Mo, Nb, V, Ta and Cr, "T" is one or more elements selected from the group consisting of Al and Ti, "X" is one or more elements selected from the group consisting of B, C, Si and P, "a" ranges from about 50–95 at. %, "b" ranges from about 0–40 at. %, "c" ranges from about 5–30 at. % and $a+b+c=100$, said alloy comprising a crystalline matrix that has an average grain size of less than about 2 micrometers and has substantially all of its constituent amounts of boron, carbon, silicon, and phosphorous held unprecipitated in a solid solution phase.

16. The article of claim 15, further comprising, admixed and consolidated in the article, at least one additional crystalline alloy consisting essentially of the formula $M_aT_bX_c$, but different in composition from the first crystalline alloy.

17. A consolidated article comprising a crystalline alloy consisting essentially of the formula $M_aT_bX_c$, wherein "M" is one or more elements selected from the group consisting of Fe, Co, Ni, W, Mo, Nb, V, Ta and Cr, "T" is one or more elements selected from the group consisting of Al and Ti, "X" is one or more elements selected from the group consisting of B, C, Si and P, "a" ranges from about 50–90 at. %, "b" ranges from about 0–40 at. %, "c" ranges from about 5–30 at. % and $a+b+c=100$, said alloy alloy comprising a substantially uniform dispersion of substantially spherical precipitates in a crystalline matrix that has an average grain size of less than about 2 micrometers, said precipitates composed of at least one metalloid selected from the group consisting of carbides, borides, silicides, and phosphides and having a maximum precipitate diameter of less than about 4 micrometers, said article further comprising diamond powder admixed and consolidated therein.

18. The article of claim 17, wherein "M" is one or more elements selected from the group consisting of Fe, Co, Ni, W, Mo, V, and Cr; "X" is one or more elements selected from the group consisting of B, C, and Si; "a" ranges from 70–95 at. %; "b" is 0; and "c" ranges from about 5–30 at. %.

19. The article of claim 17, wherein said metalloid compounds have a maximum particle diameter of less than about 1 micrometer.

20. The article of claim 18, wherein said metalloid compounds have a maximum particle diameter of less than about 1 micrometer.

21. The article of claim 17, wherein said alloy contains at least two metal components and said metalloid compounds have a maximum particle diameter of less than about 0.5 micrometer.

22. The article of claim 18, wherein said alloy contains at least two metal components and said metalloid compounds have a maximum particle diameter of less than about 0.5 micrometer.

23. The article of claim 17, further comprising, admixed and consolidated in the article, at least one additional crystalline alloy consisting essentially of the formula $M_aT_bX_c$, but different in composition from the first crystalline alloy.

24. A method for producing a consolidated metal article, comprising the steps of:

(a) selecting a rapidly solidified alloy which is at least about 50% glassy;

(b) depositing said alloy onto a substrate to form glassy alloy layer bonded thereto; and (c) heat treating said glassy alloy at a temperature ranging from about 0.55–0.85 Ts for a time sufficient to form a crystalline phase of said alloy having a hardness that is greater than the hardness of said glassy alloy.

25. The method of claim 24, wherein said crystalline alloy phase has a maximum grain size of less than about 2 micrometers.

26. A method for producing a consolidated metal article, comprising the steps of:

(a) selecting a rapidly solidified alloy, which is at least 50% glassy;

(b) forming said alloy into a plurality of alloy bodies;

(c) compacting said alloy bodies together with diamond powder at a pressing temperature of not more than about 0.6 Ts (solidus temperature measured in °C.) and at a pressure sufficient to bond said alloy bodies together and to form with the diamond powder a compact having at least about 90% T.D.; and (d) heat treating said compact at a heat treatment temperature ranging from about 0.55–0.85 Ts for a time period sufficient to provide a crystalline alloy consolidated article without graphitizing the diamond.

* * * * *

UNITED STATES PATENT AND TRADEMARK OFFICE

CERTIFICATE OF CORRECTION

PATENT NO. : 4,594,104

DATED : June 10, 1986

INVENTOR(S) : Derek Raybould

It is certified that error appears in the above-identified patent and that said Letters Patent is hereby corrected as shown below:

Front page of patent, "Reybould" should be --Raybould--.

Signed and Sealed this

Twenty-fifth Day of November, 1986

*Attest:*

DONALD J. QUIGG

*Attesting Officer* *Commissioner of Patents and Trademarks*